United States Patent [19]

Lew

[11] 4,131,999

[45] Jan. 2, 1979

[54] VARI-SCALE-STYLE SCRIBER

[76] Inventor: Hyok S. Lew, 1620 E. Blacklidge Dr. #6, Tucson, Ariz. 85719

[21] Appl. No.: 398,146

[22] Filed: Sep. 17, 1973

[51] Int. Cl.[2] ..... B43L 13/10

[52] U.S. Cl. ..... 33/23 R

[58] Field of Search ..... 33/23 R, 23 D, 23 H, 33/23 K, 25 D

[56] References Cited

U.S. PATENT DOCUMENTS

| | | | |
|---|---|---|---|
| 2,855,677 | 10/1958 | Scruggs | 33/23 R |
| 2,986,598 | 5/1961 | Hell | 33/23 R X |
| 3,555,686 | 1/1971 | Hatem | 33/23 D |
| 3,718,072 | 2/1973 | Berlant | 33/23 K X |

*Primary Examiner*—Charles E. Phillips

[57] ABSTRACT

A scribing apparatus for transcribing characters from a template onto a drawing surface in varying scales and styles.

7 Claims, 17 Drawing Figures

Fig. 1
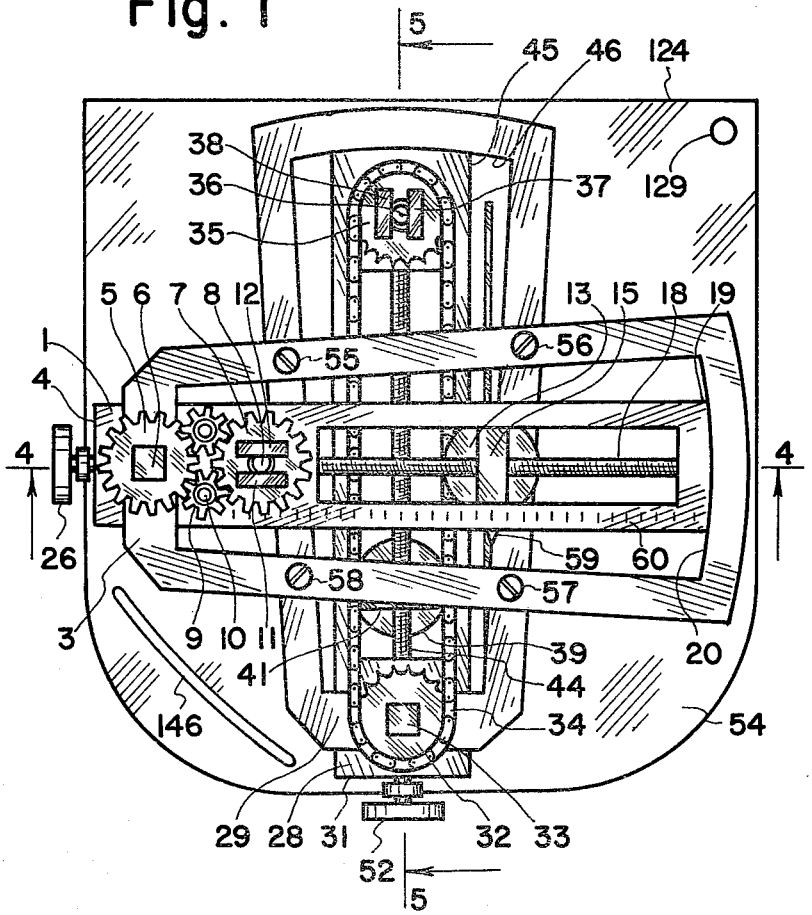
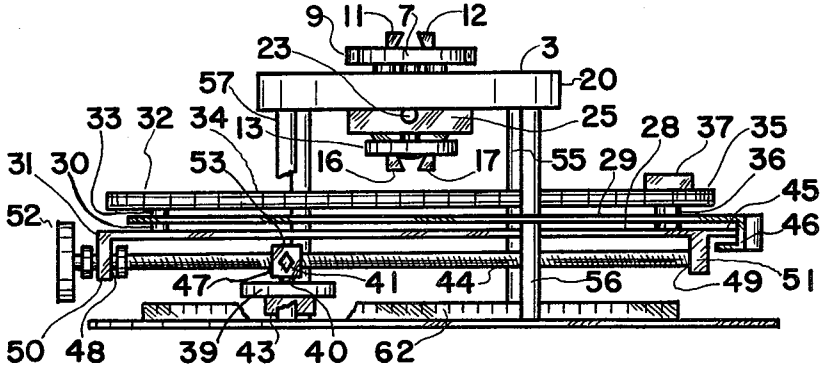
Fig. 2
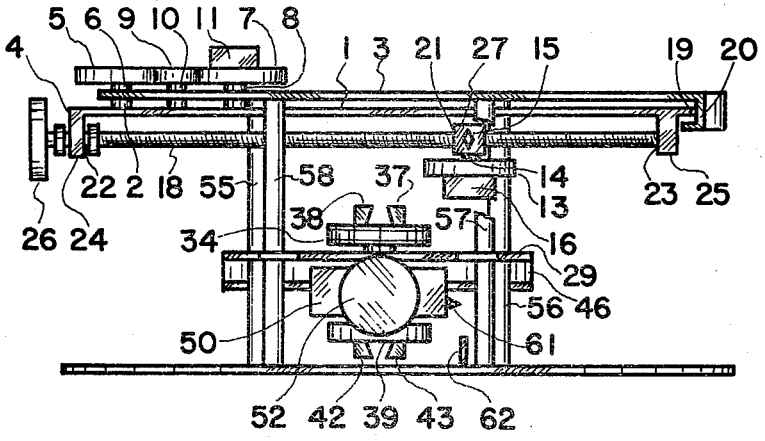
Fig. 3

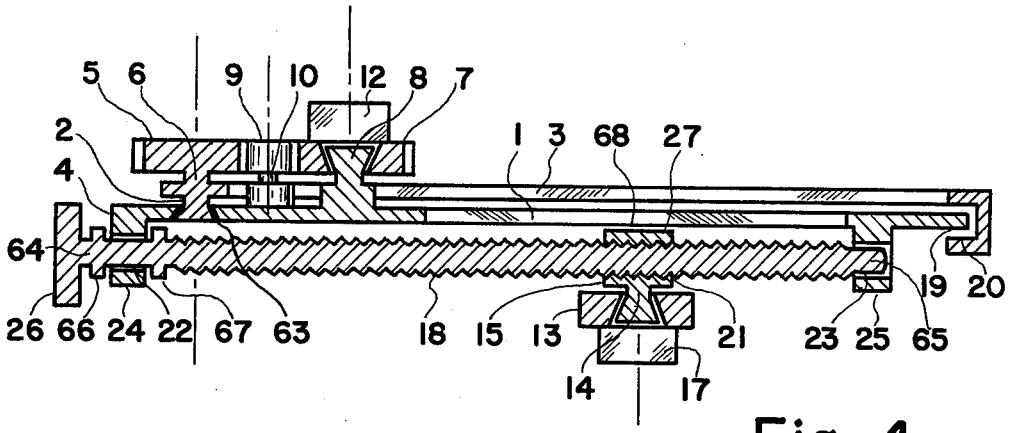
Fig. 4
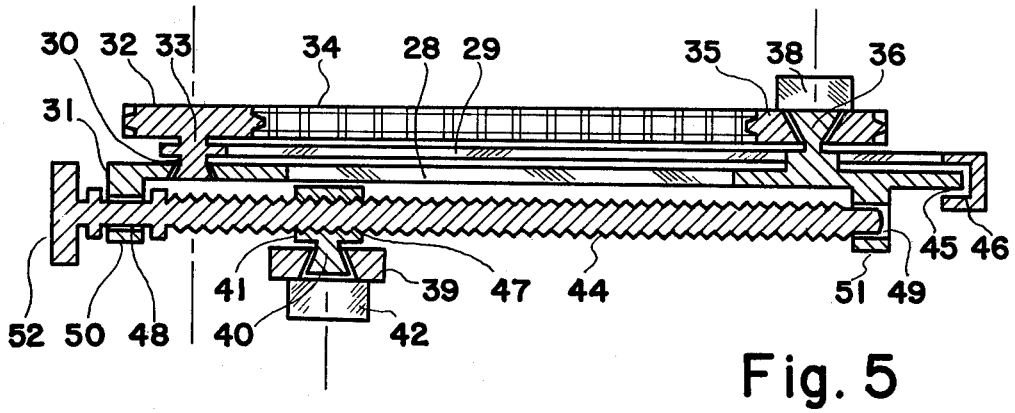
Fig. 5
Fig. 6
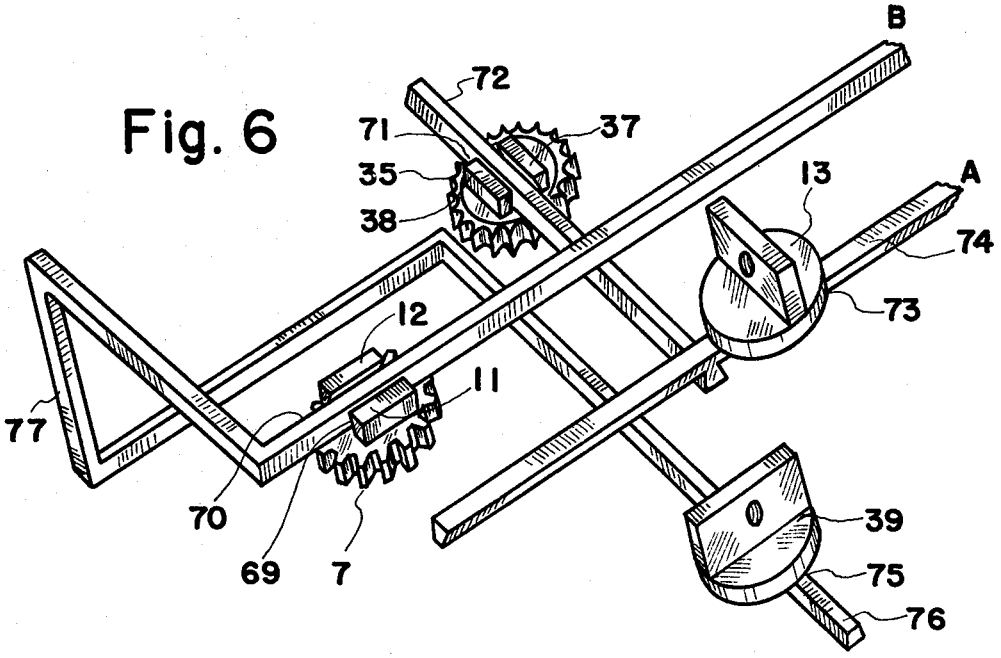

$$R\sin(\theta+\Delta\theta) = R\sin\theta + \overline{dd'}$$
$$r\sin(\theta+\Delta\theta) = r\sin\theta + \overline{cc'}$$
$$\therefore \overline{cc'}/\overline{dd'} = r/R$$

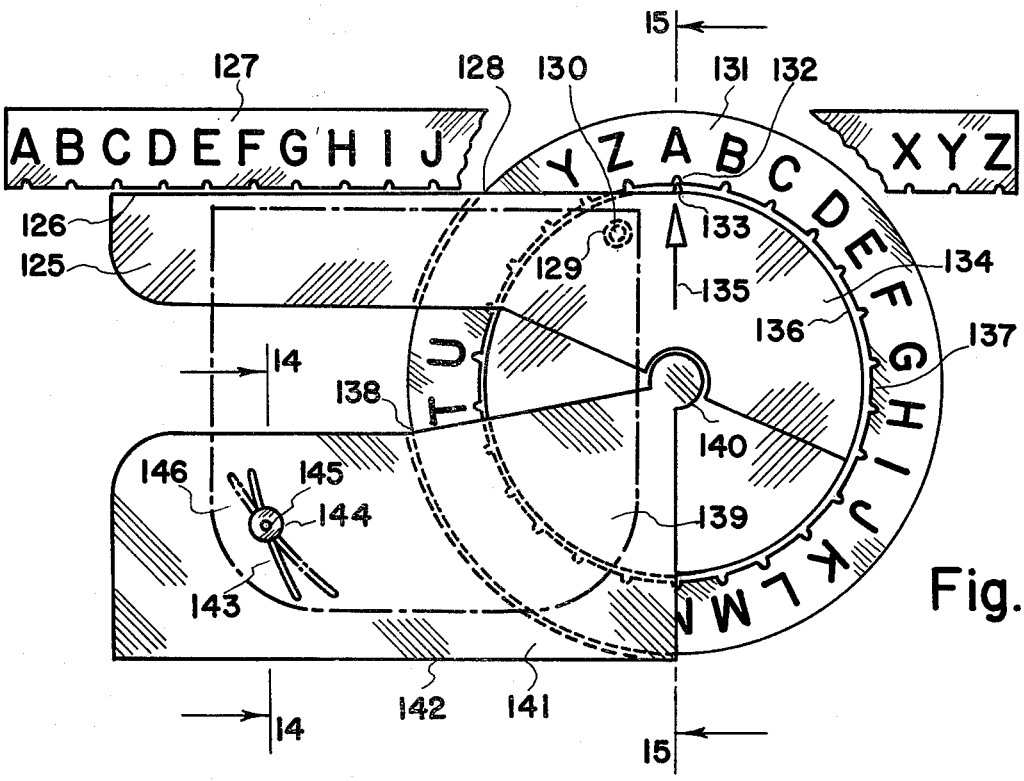
Fig. 13
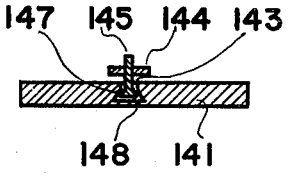
Fig. 14
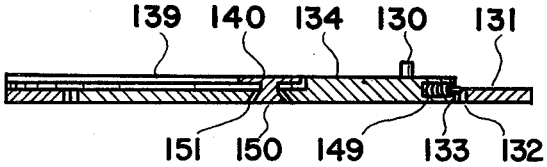
Fig. 15
Fig. 16
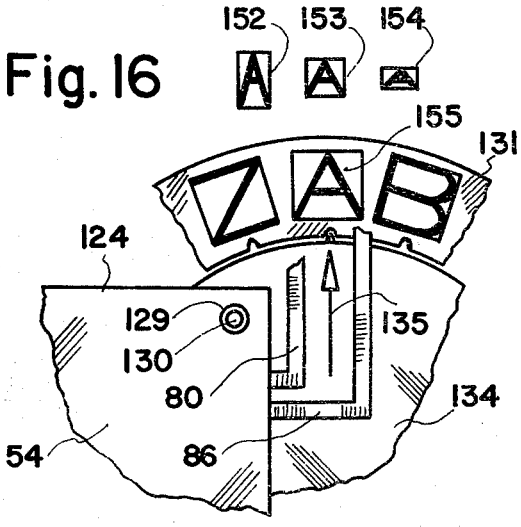
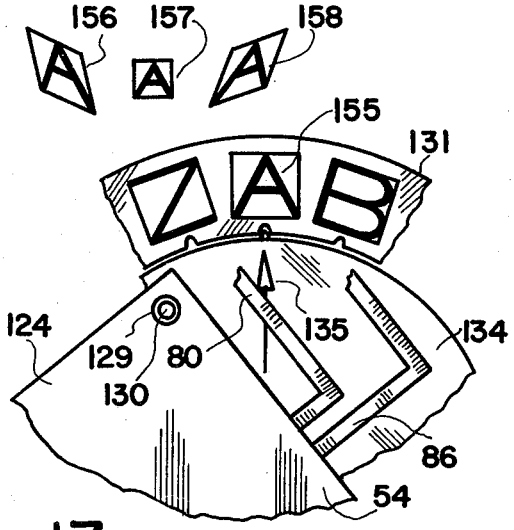
Fig. 17

VARI-SCALE-STYLE SCRIBER

This invention relates to a scribing apparatus of transcribing characters from a template onto a drawing surface in varying scales as well as in varying styles, and more particularly, to the vari-scale-style scriber capable of producing characters of different sizes, of different height-width ratios and of different slant angles from a single master template.

The lettering apparatus commonly used in the present days lack the ability to change the letter sizes as well as letter styles. As a consequence, it is necessary to have as many templates as different sizes and styles of characters employed in lettering. The amount of cost of labor, material and tooling involved in manufacturing templates are sizable. This results in a high price of templates, which makes the purchase of a complete set of templates very expensive. The price of a lettering set can be lowered drastically if a mechanically simple device capable of producing characters of varying sizes and styles from one single master template is provided.

It is therefore a primary object of the present invention to provide a vari-scale-style scriber capable of transcribing characters of varying sizes and styles from one single master template onto a drawing surface.

Another object of the present invention is to provide a vari-scale-style scriber capable of producing characters similar to those on the master template in smaller or the same or larger scale.

Yet another object of the present invention is to provide a vari-scale-style scriber capable of producing characters having height-width ratios different from those on the master template.

Still another object of the present invention is to provide a vari-scale-style scriber capable of producing characters slanted to the right or left in angles different from those on the master template.

Yet still another object of the present invention is to provide a vari-scale-style flatform having two pivoting arms, each of which arms maintains a constant orientation for the tracing and scribing implements, respectively.

A further object of the present invention is to provide a vari-scale-style flatform having means of adjusting letter sizes and styles.

A yet further object of the present invention is to provide a combination of tracing and scribing implements usable in conjunction with a vari-scale-style flatform.

A still further object of the present invention is to provide a base aiding the use of a vari-scale-style scriber in conjunction with an annular template.

These and other objects of the present invention will become apparent to those skilled in the art as the description thereof proceeds.

The present invention may be described with greater specificity and clarity with references to the following figures, in which:

FIG. 1 illustrates a top view of the vari-scale-style flatform of the present invention.

FIG. 2 illustrates a side view of the vari-scale-style flatform of the present invention.

FIG. 3 illustrates a front view of the vari-scale-style flatform of the present invention.

FIG. 4 illustrates a side view of first pivoting arm included in the vari-scale-style flatform of the present invention showing a cross section taken along line 4—4, as shown in FIG. 1.

FIG. 5 illustrates a side view of second pivoting arm included in the vari-scale-style flatform of the present invention showing a cross section taken along line 5—5, as shown in FIG. 1.

FIG. 6 illustrates an arrangement of rail structures employed in connecting the tracing and scribing implements to the vari-scale-style flatform.

FIG. 13 illustrates a top view of the base of the present invention usable in conjunction with the vari-scale-style scriber of the present invention.

FIG. 14 illustrates a further detail of the construction of the base of the present invention by showing a cross section taken along line 14—14, as shown in FIG. 13.

FIG. 15 illustrates a still further detail of the construction of the base of the present invention by showing a cross section taken along line 15—15, as shown in FIG. 13.

FIG. 16 illustrates an operation of the vari-scale-style scriber of the present invention in combination with the base of the present invention.

FIG. 17 illustrates another operation of the vari-scale-style scriber of the present invention in combination with the base of the present invention.

Figure 7:
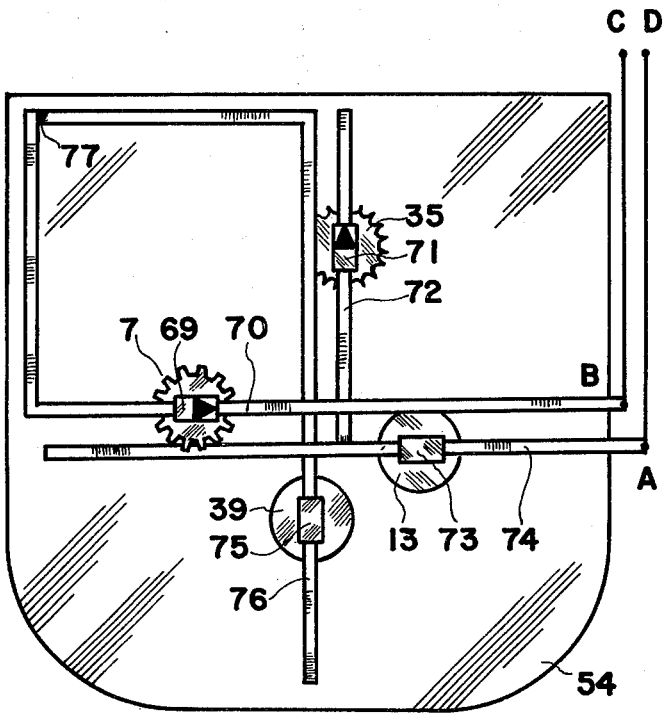
FIG. 7 illustrates a schematic diagram showing a top view of the rail structures incorporated into the vari-scale-style flatform.

Referring FIGS. 1, 2 and 3, there are shown a top view, side view and front view of a vari-scale-style flatform constructed in accordance with the principles of the present invention. A first pivoting arm 1 is journaled on a cylindrical post 2 extending downwardly from a stationary frame 3 near one extremity 4 of that pivoting arm, while other extremity 19 is guided by an arcuate guide 20 disposed on one extremity of stationary frame 3. With this arrangement, pivoting arm 1 is permitted to pivot relative to stationary frame 3 about post 2 on a horizontal plane. A first nonrotating member 5 is nonrotatably affixed to a post 6 extending upwardly from stationary frame 3, which post stems out from the same point as post 2 but in the opposite direction. The center of first nonrotating member 5 coincides with the pivoting axis of pivoting arm 1. A first rotating member 7 having the same diameter as first nonrotating member 5 is journaled on a cylindrical post 8 extending upwardly from pivoting arm 1, which post is disposed intermediate first nonrotating member 5 and extremity 19 of pivoting arm 1. Nonrotating and rotating members 5 and 7 are linked to each other by a first rotating member 9 journaled on a cylindrical post 10 extending upwardly from pivoting arm 1, which post is disposed intermediate nonrotating and rotating members 5 and 7 (in the illustrated embodiment, this linkage of gears 5 and 7 is represented by a pair of gears corresponding to gear 9). With this linking arrangement, it may be understood that as pivoting arm 1 pivots about post 2 and with respect to first nonrotating member 5, gear 7 is rotated in a direction counter to the direction of rotation of pivoting arm 1 over the same angle as the pivoted angle of pivoting arm 1. Therefore, first rotating member 7 experience no net rotation no matter how pivoting arm 1 is pivoted about post 2 on a horizontal plane. A pair of receiving guides 11 and 12 are disposed side by side on the top of first rotating member 7 to provide a receiving groove having a cross section of a trapezoid. The receiving groove provided by receiving guides 11 and 12 is aligned parallel to the lengthwise direction of stationary frame 3. It may be understood that this alignment of receiving guides 11 and 12 is always maintained even after pivoting arm 1 is pivoted relative to stationary frame 3 about post 2. A second rotating member 13 is journaled on a cylindrical post 14 extending downwardly from a block 15 to permit rotation therebetween. A pair of receiving guides 16 and 17 are disposed side by side on the bottom of second rotating member 13 to provide a receiving groove having a cross section of an inverted trapezoid. A control rod 18 disposed parallel to pivoting arm 1 threadedly engages a hole 21 disposed within the side of block 15 by means of mating threads on surfaces of both engaging members. A pair of holes 22 and 23 respectively disposed on the sides of a pair of rectangular protrusions 24 and 25 extending downwardly from extremity 4 and near the extremity 19 of pivoting arm 1, respectively, receive control rod 18 in a rotating relationship. A knob 26 is affixedly attached to one extremity of control rod 18. The top side 27 of block 15 is in contact or near contact with the bottom surface of pivoting arm 1 and thus restrains block 15 from rotating about control rod 18. With this arrangement, it may be understood that block 15 can be moved back and forth along control rod 18 as knob 26 is rotated. A second pivoting arm 28 is disposed under a stationary frame 29 in the same manner as pivoting arm 1 is disposed under stationary frame 3. The pivoting arm 28 is permitted to pivot relative to stationary frame 29 about a cylindrical post 30 on a horizontal plane as its extremity 45 is guided by an arcuate guide 46 disposed on one extremity of stationary frame 29. The stationary frame 29 has the same construction as stationary frame 3 and has second nonrotating member 32 nonrotatably affixed to a post 33 extending upwardly from the same point on stationary frame 29 as post 30. The construction of pivoting arm 28 is the same as pivoting arm 1 with the exception of the disposal of third rotating member 35 having the same diameter as second nonrotating member 32 and linking means 34 linking third rotating member 35 to 32. In other words, pivoting arm 28 can be constructed from pivoting arm 1 by replacing first rotating member 7 with third rotating member 35 and rotating member 9 (pair of gears disposed intermediate gears 5 and 7 in the illustrated embodiment) with linking means 34. Third rotating member 35 is journaled on a cylindrical post 36 extending upwardly from pivoting arm 28, which post is disposed near the extremity 45 of the pivoting arm 28. A pair of receiving guides 37 and 38 are disposed side by side on the top of third rotating member 35 to provide a guide groove having a cross section of a trapezoid, which guide groove is aligned parallel to the lengthwise direction of stationary frame 29. It may be understood that third rotating member 35 experiences no net rotation no matter how pivoting arm 28 is pivoted about post 30 and with respect to second nonrotating member 32, and consequently, said alignment of guide groove on third rotating member 35 is always maintained. The rest of elements included in pivoting arm 28 are identical to those included in pivoting arm 1. A fourth rotating member 39 journaled on a cylindrical post 40 extending downwardly from a block 41 has a pair of receiving guides 42 and 43 providing a guide groove having a cross section of an inverted trapezoid. A control rod 44 threadedly engages hole 47 disposed on a block 41. The control rod 44 is disposed parallel to pivoting arm 28 in the same manner as control rod 18 is disposed along pivoting arm 1. The block 41 can be moved along control rod 44 between two rectangular protrusions 50 and 51 as top side 53 of block 41 slides under the bottom surface of stationary frame 29. A pair of holes 48 and 49 respectively disposed on rectangular protrusions 50 and 51 extending downwardly from extremity 31 and near the extremity 45 of pivoting arm 28, respectively, receive control rod 44 in a rotating relationship. The position of block 41 along control rod 44 can be adjusted by turning knob 52 in either direction, which knob is affixedly attached to one extremity of control rod 44. In order to provide a facile pivoting movements for both pivoting arms 1 and 28 without interfering with each other, stationary frames 3 and 29 are affixedly disposed on two different horizontal planes above the base plate 54 by means of four columns 55, 56, 57 and 48 anchored on base plate 54. The stationary frames 3 and 29 are aligned normal to each other to align the receiving grooves on gears 7 and 35 normal to each other. The combinations of a pointer and a scale 59 and 60, and 61 and 62 are disposed to indicate the position of wheel 13 disposed on control rod 18 and that of wheel 39 disposed on control rod 44, respectively.

In FIG. 4, there is illustrated a further detail of the construction of first pivoting arm 1 by showing a cross section taken along line 4—4, as shown in FIG. 1. The pivoting arm 1 is pivotably disposed under stationary frame 3 as a hole 63 disposed near the extremity 4 on pivoting arm 1 is journaled on a cylindrical post 2 extending downwardly from stationary frame 3, while extremity 19 of pivoting arm 1 is guided by an arcuate guide 20 disposed on one extremity of stationary frame 3. Near the other extremity of stationary frame 3, a gear 5 is nonrotatably affixed to a post 6 extending upwardly from that stationary frame. Posts 2 and 6 have a common axis, i.e., the center of gear 5 coincides with the pivoting axis of pivoting arm 1. The enlarged lower end of post 2 retains hole 63 in position on that post. A gear 7 having the same diameter as gear 5 is journaled on a cylindrical post 8 extending upwardly from pivoting arm 1, which post is disposed intermediate gear 5 and extremity 19 of pivoting arm 1. The enlarged upper end and enlarged root of post 8 retains gear 7 in position on that post. A gear 9 journaled on a cylindrical post 10 extending upwardly from pivoting arm 1 simultaneously engages nonrotating and rotating members 5 and 7 and thus interconnects the rotations of two members. The post 10 has the same structure as post 8 and is disposed intermediate nonrotating and rotating members 5 and 7. It may be understood that posts 8 and 10 extending above the plane occupied by stationary frame 3 do not interfere with the pivoting movement of pivoting arm 1 relative to stationary frame 3 as long as the pivoting movement is limited to an extent allowed by the cutout in the middle of stationary frame 3 (see FIG. 1). A pair of receiving guides 11 and 12 affixedly disposed side by side on the top of rotating member 7 provides a receiving groove aligned parallel to the lengthwise direction of stationary frame 3. The control rod 18 is disposed along pivoting arm 1 as holes 22 and 23 disposed within a pair of rectangular protrusions 24 and 25, which rectangular protrusions extend downwardly from extremity 4 and near the extremity 19 of pivoting arm 1, receive near the extremity 64 and extremity 65 of control rod 18 in a rotating relationship, respectively. A pair of stops 66 and 67 disposed on control rod 18 sandwiches protrusion 24 and thus retains control rod 18 in position. A block 15 is movably disposed on control rod 18 as that control rod threadedly engages a hole 21 disposed within the sides of block 15. The top side 27 of block 15 maintains a contact or near-contact with the bottom surface 68 of pivoting arm 1 in a sliding relationship and thus restrains block 15 from rotating about control rod 18. A second rotating member 13 is journaled on a cylindrical post 14 extending downwardly from the bottom side of block 15 to permit rotation therebetween. The enlarged lower end and enlarged root of post 14 retains second rotating member 13 in position on that post. A pair of receiving guides 16 and 17 are affixedly disposed side by side on the bottom of second rotating member 13 to provide a receiving groove. The rotation of knob 26 affixedly attached to extremity 64 of control rod 18 moves block 15 along control rod 18 and thus provides means of adjusting the position of wheel 13 relative to first rotating member 7. The journal means employed in disposing first rotating member 7 on post 8, rotating member 9 on post 10 and second rotating member 13 on post 14 are constructed in such a way that ends of posts do not protrude over the faces of respective rotating members or that of second rotating member. Such an arrangement of journal means provides a facile reception of rails by guide grooves disposed on the faces of gears or that of wheel.

In FIG. 5, there is illustrated a further detail of the construction of second pivoting arm 28 by showing a cross section taken along line 5—5, as shown in FIG. 1. The pivoting arm 28 includes elements exactly identical to and assembled in the same manner as those included in pivoting arm 1 with the exception of linking means 34 corresponding to rotating member 9 and "third rotating member" 35 corresponding to first rotating member 7. Therefore, the description of FIG. 5 needs only that regarding to the disposal of linking means 34 and third rotating means 35. The third rotating member 35 is journaled on a cylindrical post 36 extending upwardly from pivoting arm 28, which post is disposed near the extremity 45 of that pivoting arm. The enlarged upper end and enlarged root of post 36 retains third rotating member 35 in position on that post. The upper end of post 36 is slightly sunk below the top of third rotating member 35 to provide a facile reception of a rail engaging the guide groove on third rotating member 35, which guide groove is provided by a pair of guide receivers 37 and 38 affixedly disposed side by side on the top of third rotating member 35. This guide groove is aligned parallel to the lengthwise direction of stationary frame 29. A linking means 34 links third rotating member 35 with second rotating member 32 having the same diameter as third rotating member 35. The second nonrotating member 32 is nonrotatably affixed to a post 33, which post extends upwardly from the same point on stationary frame 29 as post 30 extending downwardly.

Figure 10:
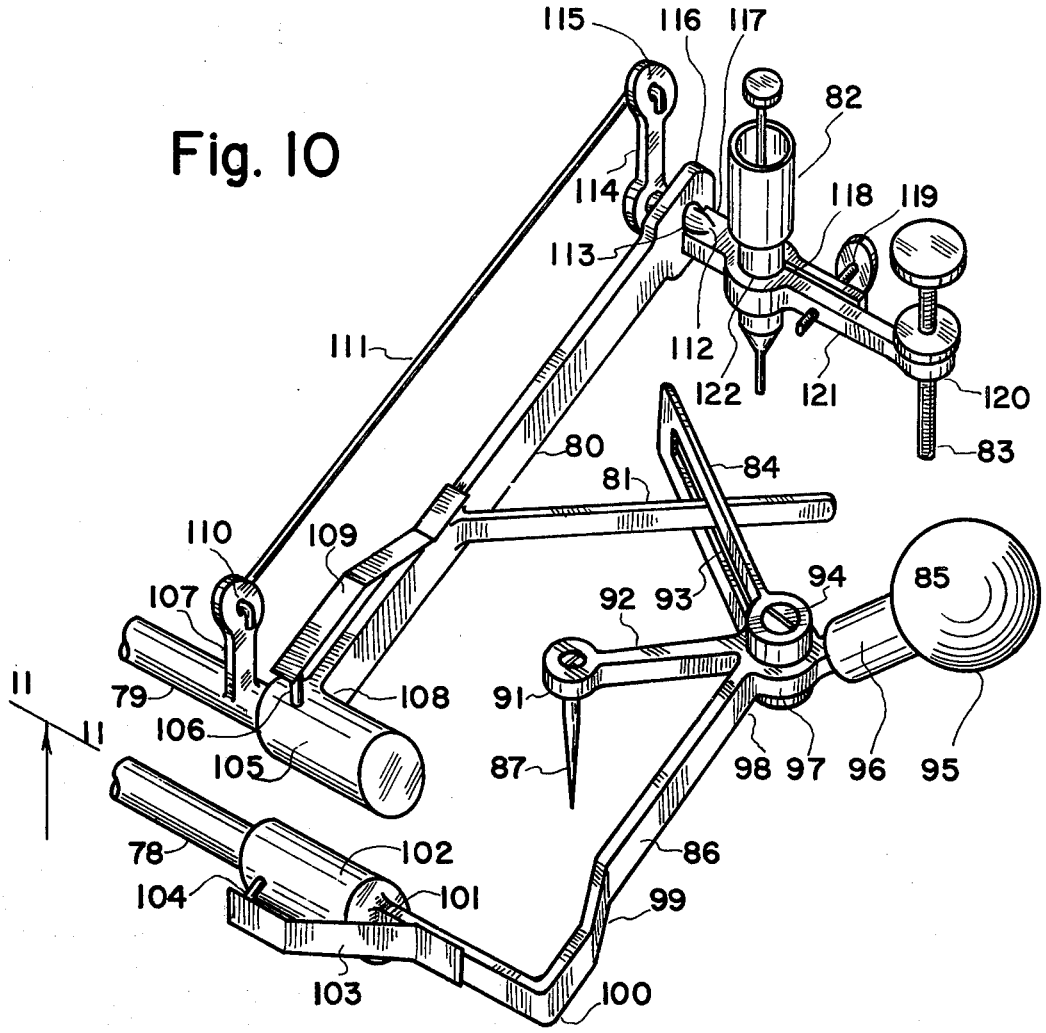
FIG. 10 illustrates a perspective view of the combination of the tracing and scribing implements of the present invention.

In FIG. 6, there is illustrated the disposals of rails engaging guide grooves on rotating member 7 and 35 and rotating member 13 and 39, which rails are employed in connecting the combination of the tracing and scribing implements shown in FIG. 10 to the vari-scale-style flatform shown in FIG. 1. The receiving groove 69 provided by receiving guides 11 and 12 on first rotating member 7 receives a rail 70 in a sliding relationship. A rail 76 engaging receiving groove 75 provided by receiving guides 42 and 43 on fourth rotating member 39 in a sliding relationship is aligned normal to rail 70 and rigidly connected to rail 70 by a rail 77 including a pair of 90 degree bends. This combination of rails 70 and 76 is designated by rail structure B. The rail structure A is composed of two rails 72 and 74 rigidly jointed normal to each other as rails 72 and 74 slidably engage receiving grooves 71 and 73, respectively, each of which receiving grooves is provided by receiving guides 37 and 38 on third rotating member 35 and receiving guides 16 and 17 on wheel 13, respectively. It may be understood that each of mating receiving grooves and rails has a matching cross section of trapezoid, which combination of cross sections restrains rails from disengaging from mating grooves. With rail structures A and B engaging receiving grooves included in the vari-scale-style flatform as shown in FIG. 6, both rail structures can be shifted in all directions on a horizontal plane, while they are restrained from rotating about an axis perpendicular to the horizontal plane as receiving groove 69 on first rotating member 7 and receiving groove 71 on third rotating member 35 maintain constant orientations for rail structures B and A, respectively, which orientations are intrinsic to each of the rail structures A and B.

FIG. 7 schematically illustrates a top view of rail structures A and B engaging receiving grooves included in the vari-scale-style flatform. The relative positions of two rail structures A and B embodied in the figure correspond to positions resulting from a small clockwise pivoting movement of rail structure A from the reference position, where one rail structure becomes aligned above the other rail structure. It is obvious that a movement of rail structure A causes a movement of rail structure B. A movement of rail structure A on a horizontal plane moves one or both of receiving grooves 71 and 73, which in turn moves one or both of receiving grooves 69 and 75, and thus results in a movement of rail structure B. Therefore, when a tracing implement represented by point D, which implement is rigidly connected to rail structure A, is moved in conformance with a character, a scribing implement represented by point C, which scribing implement is rigidly connected to rail structure B, describes a character related to that traced by point D.

Figure 8:
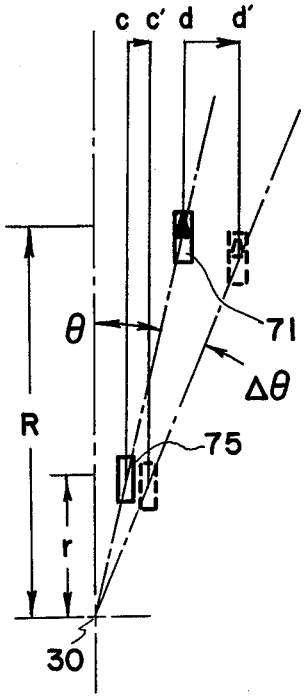
FIG. 8 illustrates a geometrical relationship involved in the operation of the vari-scale-style flatform of the present invention.

In FIG. 8, there is illustrated a geometrical relationship between movements of points D and C representing the tracing and scribing points, respectively. When point D is moved from a point d to another point d' from left to right, point C moves from a point c to another point c' from left to right as second pivoting arm including receiving grooves 71 and 75 becomes pivoted about pivoting point 30 of that pivoting arm from angle $\theta$ to another angle $(\theta + \Delta\theta)$, which angles are measured from the reference position corresponding to zero pivoting angle. The distance from pivoting point 30 to receiving groove 71 (precisely speaking, to post 36) is designated by R, while the distance from the same pivoting point to receiving guide 75 (i.e., to post 40) is designated by r (see also FIGS. 1 and 2). The formulas appearing in the bottom of FIG. 8 can be obtained after simple algebra. According to these formulas, the ratio of movement of point C over that of point D is equal to the ratio of r over R. A formula corresponding to that shown can be obtained for up and down movements of points D and C. The following facts can be discovered from those formulas: Firstly, an up and down movement of point D causes a movement of point C in the same direction. Secondly, the ratio of the movement of point C in that direction over the movement of point D in the same direction is equal to the ratio of the distance from post 2 to post 8 over the distance from post 2 to post 14 (see FIGS. 1 and 3). Thirdly, a right and left movement of point D causes a movement of point C in the same direction. Fourthly, the ratio of the movement of point C in that direction over the movement of point D in the same direction is equal to the ratio of the distance from post 30 to post 40 over the distance from post 30 to post 36 (see FIGS. 1 and 2). It is obvious from these facts that a combination of the vari-scale-style flatform and the tracing and scribing implements, which is named the vari-scale-style scriber, can be used in transcribing characters or figures from a single master template onto a drawing surface in many different sizes and styles.

Figure 9:
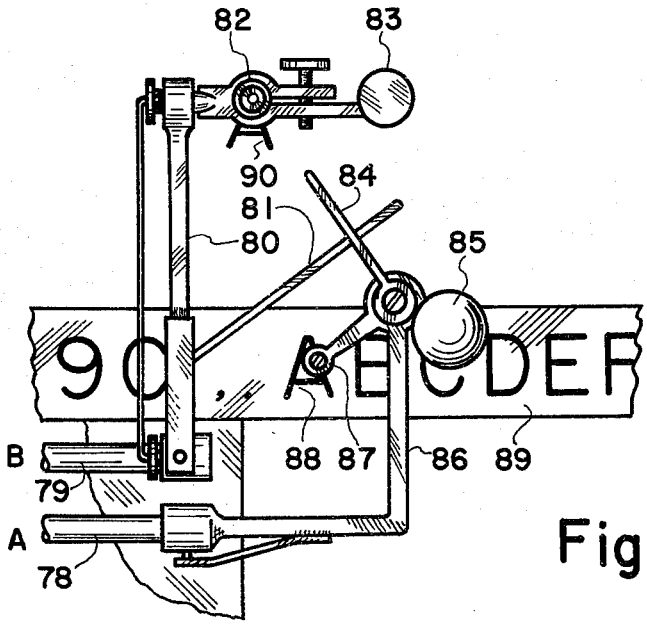
FIG. 9 illustrates a top view of the combination of the tracing and scribing implements of the present invention connected to the rail structures of the vari-scale-style flatform of the present invention.

In FIG. 9, there is illustrated a top view of a combination of the tracing and scribing implements arranged in accordance with the principles of the present invention, which combination is usable in conjunction with the vari-scale-style flatform of the present invention. A tracing implement including a tracing pin 87, a handle 85 and a lever 84 having a slit disposed within the sides of that lever is connected to rod 78 extending from rail structure A by an arm 86. A scribing implement including scribing pen 82 and a support pin 83 is connected to rod 79 extending from rail structure B by an arm 80, which arm has a lever 81 extending horizontally and engaging the slit disposed on lever 84. Movements of tracing pin 87 in conformance with character 88 formed in grooves on template 89, as that pin is moved in character grooves manually by a person holding handle 85 with one hand, causes scribing pen 82 to describe that character on the drawing surface. Depending on the ratios of distances between posts mentioned in the description of FIG. 8, scribing pen 82 describes character 90 smaller or the same or larger or taller or broader than character 88 on template 89. The lever 81 engaging slit disposed within lever 84 locks the movement of the tracing implement with the movement of the scribing implement when either implement is moved upwardly from or downwardly to the drawing surface, while movements of both implements on the drawing surface is not effected by those levers. With this arrangement of levers 81 and 84, it may be understood that lifting the tracing implement from the template on the completion of transcribing a character automatically lifts the scribing implement from the drawing surface and lowering of the tracing implement onto the template at the begining of transcribing a character automatically lowers the scribing implement onto the drawing surface.

The combination of the tracing and scribing implements shown in FIG. 9 is illustrated in a further detail in FIG. 10 showing a perspective view of that combination. The tracing implement including a tracing pin 87, a handle 85 and a lever 84 having a slit 93 disposed lengthwise within the side of that lever, is connected to rod 78 by an arm 86 having a 90 degree bend 100 on horizontal plane, which bend is disposed intermediate two extremities of that arm. The extremity 98 of arm 86 has a circular enlargement 97, from which an arm 92 extends radially in an angle less than 90 degrees with respect to arm 86. The tracing pin 87 selectively positionable by means of threads is affixed to a circular enlargement 91 disposed on the extremity of arm 92 as the upper half of tracing pin 87 is threadedly engaged within circular enlargement 91. The stem 96 of handle 85 extends upwardly from circular enlargement 97 and is slanted to a direction approximately diametrical to arm 92. A ball 95 having a diameter greater than the diameter of stem 96 is affixed to the upper end of stem 96 to provide a facile means of holding. The enlarged end 94 of lever 84, selectively positionable by means of screw, is screwedly affixed to circular enlargement 97. A portion of arm 86 adjacent to circular enlargement 97 is elevated from rest of that arm by a bend 99 on vertical plane, which bend is disposed intermediate 90 degree bend 100 and circular englargement 97. The extremity 101 of arm 86 has a cylindrical enlargement 102 disposed parallel to the adjacent portion of arm 85 and journaled on rod 78, which rod is rigidly connected to rail structure A. A pin 104 having a spring bias 103 restrains cylindrical enlargement 102 from disengaging from rod 78 (see FIG. 11). The scribing implement including a scribing pen 82 and a support pin 83 is connected to rod 79 by an arm 80, which rod is rigidly connected to rail structure B. The support pin 83, selectably positionable by means of threads, is threadedly engaged within a beam 121 near its extremity 120. The scribing pen 82 is disposed within a hole 122 including an opening 118, which hole is disposed intermediate two extremities of beam 121. A screw 119 threadedly closing the opening 118 retains scribing pen 82 in position within hole 122. The extemity 117 of beam 121 includes a cylindrical extension 112 rotatably engaging a hole 113 disposed near the extremity 116 of arm 80. An arm 114 extends upwardly from the end of cylindrical extension 112. It may be understood that the journal means of engaging cylindrical extension 112 with hole 113 is arranged in such a way that beam 121 is restrained from moving relative to arm 80 in any direction, while that beam is permitted to rotate about an axis parallel to the lengthwise direction of that beam. A lever 81 extends laterally from arm 80 and engages slit 93 disposed within lever 84 in a sliding relationship. The extremity 108 of arm 80 has a cylindrical enlargement 105 disposed normal to arm 80 and journaled on rod 79. A pin 106 having a spring bias 109 restrains cylindrical enlargement 105 from disengaging from rod 79. An arm 107 extending upwardly from rod 79 is connected with arm 114 by a rod 111 as two extremities of rod 111 bent to 90 degrees rotatably engage holes 110 and 115 disposed near the extremities of arms 107 and 114, respectively. Further 90 degree bends disposed near very extremities of rod 111 retain two extremities of that rod in position within holes 110 and 115, resprectively. The connection of arms 107 and 114 by rod 111 is arranged in such a way that beam 121 is restrained from rotating about its axis as long as the tip of the scribing pen remains on the drawing surface. With these arrangements of connecting the combination of the tracing and scribing implements to the vari-scale-style flatform, it may be understood that the tracing scribing implements cannot be be moved relative to rail structures A and B, respectively, on horizontal planes (especially, on the drawing surface), while those implements can be pivoted about an axis parallel to rods 78 and 79.

Figure 11:
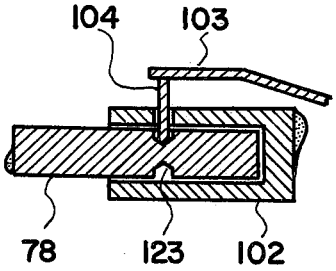
FIG. 11 illustrates a journal means employed in connecting the tracing and scribing implements of the present invention to the rail structures of the vari-scale-style flatform showing a cross section taken along line 11—11, as shown in FIG. 10.

In FIG. 11, there is illustrated a detail of the construction of journal means employed in connecting arms 80 and 86 to rods 79 and 78, respectively. The cross section taken along line 11—11, as shown in FIG. 10, illustrates a detail of the arrangement of journaling cylindrical enlargement 102 on rod 78. The rod 78 includes a groove 123 disposed around its surface like a ring. The end of pin 104, which pin is retained in a hole disposed on the side of cylindrical enlargement 102, engages groove 123 in the urge of spring 103 and thus restrains cylindrical enlargement 102 from disengaging from rod 78, while cylindrical enlargement 102 is permitted to rotate about rod 78 as the tip of pin 104 slides in groove 123. By lifting pin 104 against the urge of spring 103 and then pulling cylindrical enlargement 102 away from rod 78, the tracing implement can be disconnected from the vari-scale-style flatform. The same construction as that described is employed in journaling cylindrical enlargement 105 on rod 79.

Figure 12:
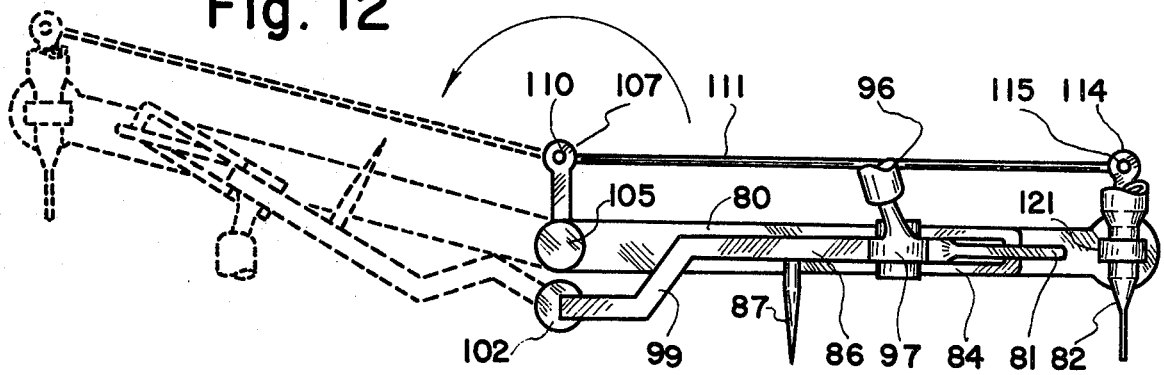
FIG. 12 illustrates the operation of the journal means employed in connecting the tracing and scribing implements to the rail structures of the vari-scale-style flatform.

In FIG. 12, there is illustrated advantages provided by the use of journal means shown in FIG. 11 in connecting the combination of the tracing and scribing implements to the vari-scale-style flatform. It becomes obvious from FIG. 12 that the combination of the tracing and scribing implements can be simultaneously lifted from or lowered onto the drawing surface as well as it can be swung over to the resting position outlined in broken lines as rod 111 linking holes 110 and 115 disposed on arms 107 and 114, respectively, maintains scribing pen 82 in the up-right position all the time. It may be noticed that rod 78 is disposed below rod 79 to permit a facile movement therebetween and that bend 99 elevates a portion of arm 86 adjacent to circular enlargement 97 to the same level as arm 80 to permit a facile engagement of lever 81 with slit 93 disposed within lever 84.

It becomes apparent from the preceding descriptions to those skilled in the art that a vari-scale-style scriber including a vari-scale-style flatform and a combination of the tracing and scribing implements connected to each other transcribes characters from a template onto a drawing surface in varying scales as well as varying styles. Referring to FIG. 1, distances between posts 2–14 and 30–40 can be adjusted by rotating knobs 26 an 52 in either directins, respectively. Therefore, the ratio of distances between posts 2–8 over 2–14 and the ratio of distances between posts 30–40 over 30–36 can be adjusted and set to any values independently within the extent permitted by the construction of the vari-scale-style flatform. When ratios 2–8 over 2–14 and 30–40 over 30–36 are set to the same value, the scribing implement o the vari-scale-style scriber describes characters similar to those traced by the tracing implement of the vari-scale-style scriber in smaller or the same or larger sizes depending whether the ratios of distances between posts are set to a value less than or equal to or greater than unity. When the ratios 2–8 over 2–14 and 30–40 over 30–36 are set to two different values, the scribing implement of the vari-scale-style scriber describes characters having the height-width ratio different from those traced by the tracing implement of the vari-scale-style scriber. Therefore, the size as well as the height-width ratio of characters can be adjusted in transcribing characters by using a vari-scale-style scriber. The vari-scale-style scriber also has a ability to adjust the slant angle of characters. When a template is aligned parallel to the upper side 124 of the vari-scale-style flatform, a square on a template can be transcribed to rectangles of different sizes and different height-width ratios, which includes squares of different sizes. When a template is aligned in an angle, for example, 45 degrees with respect to the upper side 124 of the vari-scale-style flatform, a square on a template can be transcribed to rhomboids of different sizes and different ratios of diagonals. A character disposed within the square on the template in the up-right style are transcribed to corresponding characters disposed in corresponding rhomboids in a slanted angle. It becomes apparent from this fact that a vari-scale-style scriber transcribes characters in varying slant angles.

In FIG. 13, there is illustrated the base of the present invention usable in conjunction with the vari-scale-style scriber of the present invention. This base includes a central disk 134 whose side 136 guides inner side 137 of an annular template 131 disposed around central disk 134 in a sliding relationship, and a guide 139 guiding the vari-scale-style scriber mounted on the base along a linear guide secured on the drawing surface. The arm 125 extending from the upper half of central disk 134, which arm has the upper side 126 tangential to the rim of central disk 134, guides a linear template 127. A cavity 128 is disposed on the bottom surface of arm 125 adjacent to central disk 134 to receive annular template 131. A spring biased detent 133 disposed on the uppermost side of central disk 134 engages an indentation 132 positionally corresponding to a character brought to the position marked by an arrow 135, and thereby secures that character in position for a facile transcription. A character disposed on linear template 127, which character is brought to the position marked by arrow 135 for transcription, can be secured in position as detent 133 engages an indentation 132 positionally corresponding to that character. The indentations identical to that of 132 are disposed on inner side 137 of annular template 131 and on the lower side of linear template 127 in such a way that each indentation positionally corresponds to each character disposed on the template. The guide 139 is pivoted at the center of central disk 134 to permit rotation with respect to central disk 134. The arm 141 extending laterally from guide 139 includes a cavity 138 disposed on the bottom surface adjacent to central disk 134 to receive annular template 131 and has lower side 142 tangential to the outer rim of annular template 131. The lower side 142 of guide 139 guides the vari-scale-style scriber mounted on the base along the upper side of a linear guide securely placed on the drawing surface. The vari-scale-style scriber can be mounted on the top of the base as a cylindrical post 130 extending upwardly from central disk 134 rotatably engages a hole 129 disposed on base plate 54 near its upper left corner. The vari-scale-style scriber mounted on the top of the base is outlined in broken lines. A bolt 145 threadedly engaging a nut 144 is slidably planted within an arcuate slit 143, which arcuate has the center located on the center of central disk 134. The bolt 145 also engages an arcuate slit 146 disposed on base plate 54 near its lower left corner when the vari-scale-style flatform is mounted on the top of the base. The center of arcuate slit 146 coincides with hole 129. With this arrangement, it may be understood that guide 139 and the vari-scale-style flatform mounted on the base can be rotated independently with respect to central disk 134 to any angular positions within the extent of slits 143 and 146, and then can be locked in those angular positions by means of nut 144 threadedly engaging bolt 145. The slits 143 and 146 may be made long enough to provide the necessary range of rotation for guide 139 and the vari-scale-style flatform mounted on the base.

In FIG. 14, there is illustrated a further detail of the arrangement of bolt 145 planted in slit 143 by showing a cross section of arm 141 taken along line 14—14, as shown in FIG. 13. The enlarged bottom 147 of slit 143 receives the enlarged head 148 of bolt 145. With this arrangement, bolt 145 is retained in slit 143, while that bolt is permitted to move along that slit.

There is illustrated in FIG. 15 a further detail of the construction of the base by showing a cross section taken along line 15—15, as shown in FIG. 13. The spring bias 149 of detent 133 permits annular template 131 to be easily rotated manually and thereby afford facile selection of the character. A cylindrical post 150 extending downwardly from circular enlargement 140 rotatably engages a hole 151 disposed on central disk 134 at its center. The enlarged lower end of post 150 restrains that post from disengaging from hole 151, while the lower end of post 150 slightly sunken into hole 151 inhibits that post from damaging the drawing surface when the base is moved on the drawing surface. It may be noticed that the upper half of the top surface of central disk 134 is elevated to provide the top surface even with that of guide 139.

In FIGS. 16 and 17, there is illustrated the operation of the vari-scale style scriber of the present invention mounted on the base of the present invention. Depending on amplification or deamplification ratios between the movements of the tracing pin and the scribing pen in two reference directions normal to each other, the scribing pen attached to arm 80 describes character 153 similar to but smaller (or larger) or character 152 taller or character 154 broader than character 155 on template 131, which character is traced by the tracing pin attached to arm 86. In these examples of transcription, the slant angle of characters is not changed as the vari-scale-style flatform is positionally set to an orientation, in which upper side 124 of base plate 54 of the vari-scale-style flatform is aligned normal to arrow 135 appearing on central disk 134 of the base. When the vari-scale-style flatform is positionally set to an orientation where upper side 124 of base plate 54 makes an angle, for example, 45 degrees with respect to arrow 135 on central disk 134, the square enclosing character 155 on template 131 can be transcribed to a square 157 or rhomboids 156 and 158 having unequal diagonals. It becomes apparent from this fact that the scribing pen attached to arm 80 describes slanted to the right or left in varying degrees as the tracing pin attached to arm 86 traces characters of up-right style disposed on template 131, when the vari-scale-style scriber is positionally set to an orientation which is not aligned parallel to arrow 135 on central disk 134. The slant angles of characters can be adjusted by adjusting the orientation of the vari-scale-style scriber with respect to the base in combination with two unequally set amplification or deamplification ratios of the vari-scale-style flatform. In scribing slanted characters, arm 141 of guide 139 may be rotated to an orientation where lower side 142 of that guide becomes aligned parallel to the lower base of rhomboids 156 or 158 to align the transcribed characters along a predetermined line as a linear guide securely placed on the drawing surface guides lower side 142 of guide 139 along that line.

It is perfectly feasible to use a pair of pivoting arms having exactly the same construction in constructing a vari-scale-style flatform. For example, the use of a pair of pivoting arms having the same construction as that shown in FIG. 5 with an exception of the disposal of third rotating member 35, which rotating member is now disposed in the middle of the pivoting arm instead of near extremity, will save the cost of manufacturing and provide greater versatility compared with the vari-scale-style flatform embodied in FIG. 1. It is not difficult to realize the fact that a vari-scale-style scriber having deamplification or amplification capability only can be constructed to a dimension as small as half a vari-scale-style scriber having both amplification and deamplification capability. The illustrative embodiment is employed to demonstrate the feasibility of constructing a small size vari-scale-style scriber having deamplification capability only as well as to describe the principles of the present invention. However, it is a primary object of the present invention to provide the principles of constructing a vari-scale-style scriber having both amplification and deamplification capability and that with amplification capability only and that with deamplification capability only. It should be mentioned that the control rod 44 can be arranged side by side with linking means 34 in such a way that fourth rotating member 39 is disposed on the same level as third rotating member 35 (see FIG. 5), which method of construction can be also applied to the pivoting arm shown in FIG. 4. Such an arrangement is advantageous in constructing a vari-scale-style flatform having small height. It should be further mentioned that the combined use of rotating member and linking means in connecting members 5 and 7, and 32 and 35, respectively, is not necessary (see FIG. 1). Both pairs of members may be connected by chains, belts or wires, or by any combination of said means or by other means such as connecting rods installed to serve the same purpose as that of 111 (see FIG. 10).

While the principles of the invention have now been made clear in an illustrative embodiment, there will be immediately obvious to those skilled in the art many modifications of structures, arrangement, proportions, the elements, materials and components used in the practice of the invention which are particularly adapted for specific environments and operating requirements without departing from those principles.

I claim:

1. A device for transmitting the movement of a tracing implement to the movement of a scribing implement, said device constituting an essential element of a transcribing apparatus capable of transcribing characters from a template onto a drawing surface in varying sizes and styles; said device comprising:

(e) a base-plate (a) a first pivoting arm pivotally secured to a first post near one extremity of said first pivoting arm, said first post being nonrotatably secured to said base-plate whereby, said first pivoting arm is pivotable about said first post on a plane parallel to said base-plate with respect to said base-plate, said first pivoting arm including:

(2) a first rotating member rotatably secured to a second post, said second post secured to said first pivoting arm immediate said first post and the other extremity of said first pivoting arm; whereby, said first rotating member is rotatable relative to said first pivoting arm about an axis perpendicular to said base-plate;

(3) a first nonrotating member nonrotatably secured to said first post;

(4) a first means for interconnecting said first rotating member and said first nonrotating member; whereby, pivotal movement of said first pivoting arm in one direction results in equal angular rotation of said first rotating member in another direction to maintain the constant angular orientation of said first rotating member during pivotal movement of said first pivoting arm with respect to said base-plate;

(5) a first receiving means affixedly secured upon said first rotating member, said first receiving means aligned in the first direction on a plane parallel to said base-plate;

(6) a second rotating member rotatably secured to a first block, said first block movably secured to said first pivoting arm; whereby, said second rotating member is rotatable relative to said first pivoting arm about an axis perpendicular to said base-plate, and said first block is movable along said first pivoting arm between two extremities of said first pivoting arm;

(7) a second receiving means affixedly secured to said second rotating member; whereby, the alignment of said second receiving means is changable on a plane parallel to said base-plate; and (8) a first mean of changing and setting the position of said first block movably secured to said first pivoting arm;

(b) a second pivoting arm pivotally secured to a third post near one extremity of said second pivoting arm, said third post being nonrotatably secured to said base-plate; whereby, said second pivoting arm is pivotable about said third post on a plane parallel to said base-plate with respect to said base-plate, said second pivoting member including:

(2) a third rotating member rotatably secured to a fourth post, said fourth post secured to said second pivoting arm intermediate said third post and the other extremity of said second pivoting arm; whereby, said third rotating member is rotatable relative to said second pivoting arm about an axis perpendicular to said base-plate;

(3) a second nonrotating member nonrotatably secured to said third post;

(4) a second means for interconnecting said third rotating member and said second nonrotating member; whereby, pivotal movement of said second pivoting arm in one direction results in equal angular rotation of said third rotating member in another direction to maintain the constant angular orientation of said third rotating member during pivotal movement of said second pivoting arm with respect to said base-plate;

(5) a third receiving means affixedly secured upon said third rotating member, said third receiving means aligned in the second direction on a plane parallel to said base-plate;

(6) a fourth rotating member rotatably secured to a second block, said second block movably secured to said second pivoting arm; whereby, said fourth rotating member is rotatable relative to said second pivoting arm about an axis perpendicular to said base-plate, said second block is a movable along said second pivoting arm between two extremities of said second pivoting arm;

(7) a fourth receiving means affixedly secured to said fourth rotating member; whereby, the alignment of said fourth receiving means is changable on a plane parallel to said base-plate; and (8) a second means of changing and setting the position of said second block movably secured to said second pivoting arm;

(c) means for connecting a tracing implement to said device, said means including:

(1) a first rod having means of connecting a tracing implement to one extremity of said first rod, (2) a first rail aligned in said second direction and rigidly connected to said first rod, said first rail slidably engaging said third receiving means; and (3) a second rail aligned in said first direction and rigidly connected to said first rod, said second rail slidably engaging said second receiving means; whereby, the constant angular orientation of said first rod is maintained during shifting movement of said first rod on a plane parallel to said base-plate;

(d) means for connecting a scribing implement to said device, said means including:

(1) a second rod having means of connecting a scribing implement to one extremity of said second rod;

(2) a third rail aligned in said first direction and ridigly connected to said second rod, said third rail slidably engaging said first receiving means; and (3) a fourth rail aligned in said second direction and rigidly connected to said second rod, said fourth rail slidably engaging said fourth receiving means, whereby, the constant angular orientation of said second rod is maintained during shifting movement of said second rod on a plane parallel to said base-plate.

2. The device as set forth in claim 1 wherein said first direction is normal to said second direction.

3. The device as set forth in claim 2 wherein the angle between said first and second pivoting arms varies within a range of angles greater than 0 degree and equal to or less than 360 degrees during pivotal movements of said first and second pivoting arms associated with the transcribing operation.

4. The device as set forth in claim 3 wherein said receiving means comprise receivers for slidably engaging said rails.

5. The device as set forth in claim 4 wherein said rotating member and said nonrotating member interconnected to each other comprise circular members having the same diameter.

6. The device as set forth in claim 5 wherein said means of interconnecting each pair of said rotating member and said nonrotating member to each other comprise a tractive device interlocking rotational motion.

7. The device as set forth in claim 6 wherein said means of moving and setting position of each said block comprise (a) control rod engaging a hole disposed within said block, said control rod secured to said pivoting arm in an alignment parallel to said pivoting arm.

* * * * *